US008688010B2

(12) United States Patent
Kato

(10) Patent No.: US 8,688,010 B2
(45) Date of Patent: Apr. 1, 2014

(54) DEVELOPING CARTRIDGE

(71) Applicant: Shuichi Kato, Nagoya (JP)

(72) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/970,275

(22) Filed: Aug. 19, 2013

(65) Prior Publication Data

US 2013/0330102 A1 Dec. 12, 2013

Related U.S. Application Data

(63) Continuation of application No. 13/071,545, filed on Mar. 25, 2011, now Pat. No. 8,532,536.

(30) Foreign Application Priority Data

Jun. 30, 2010 (JP) ..... 2010-149669

(51) Int. Cl.
*G03G 15/08* (2006.01)

(52) U.S. Cl.
USPC ..... 399/222; 399/225

(58) Field of Classification Search
USPC ..... 399/222
See application file for complete search history.

(56) References Cited

U.S. PATENT DOCUMENTS

| | | | |
|---|---|---|---|
| 6,459,869 | B2 | 10/2002 | Nittani et al. |
| 7,522,860 | B2 | 4/2009 | Shiraki |
| 2001/0022902 | A1 | 9/2001 | Nittani et al. |
| 2005/0063735 | A1 | 3/2005 | Okabe |
| 2006/0171739 | A1 | 8/2006 | Nakaya |
| 2007/0059038 | A1 | 3/2007 | Shiraki |
| 2008/0159775 | A1 | 7/2008 | Koishi et al. |
| 2009/0169257 | A1 | 7/2009 | Sato et al. |

FOREIGN PATENT DOCUMENTS

| | | | |
|---|---|---|---|
| JP | 2001249542 | A | 9/2001 |
| JP | 2001272901 | A | 10/2001 |
| JP | 2003057947 | A | 2/2003 |
| JP | 3720707 | B2 | 11/2005 |
| JP | 2007-079139 | A | 3/2007 |

*Primary Examiner* — Clayton E Laballe
*Assistant Examiner* — Jas Sanghera
(74) *Attorney, Agent, or Firm* — Banner & Witcoff, Ltd.

(57) ABSTRACT

A developing cartridge having a first side plate and a second side plate spaced opposite from the first side plate, a developer carrying member rotatably supported between the side plates, a developer supplying member rotatably supported between the side plates, a input member to which driving force is input rotatably supported by the first side plate, a primary developing gear to which the driving force is transferred provided on the developer carrying member at the first side plate, a secondary developing gear to which the driving force is transferred provided on the developer carrying member at the second side plate, and a supply gear to which the driving force is transferred provided on the developer supplying member at the second side plate, wherein the input member and the supply gear are arranged so that their projections in the direction of the rotation axis of the developer supplying member overlap.

11 Claims, 9 Drawing Sheets

DEVELOPING CARTRIDGE

CROSS-REFERENCE TO RELATED APPLICATION

This application is a continuation of U.S. patent application Ser. No. 13/071,545 filed Mar. 25, 2011, which claims priority from Japanese Patent Application No. 2010-149669, filed on Jun. 30, 2010, the entire subject matter of which is incorporated herein by reference.

TECHNICAL FIELD

Aspects of the present invention relate to a developing cartridge mountable in an image forming apparatus, such as a laser printer.

BACKGROUND

In an example of an image forming apparatus such as a laser printer, a drum cartridge holding a photosensitive drum is removably provided in the apparatus body, and a developing cartridge holding a developing roller is mounted to the drum cartridge.

When the developing cartridge is mounted to the drum cartridge, the developing roller is pressed against the surface of the photosensitive drum. When the developing roller is pressed against the surface of the photosensitive drum, since the pressed part of the developing roller moves in the same direction as the surface of the photosensitive drum, the developing roller is rotated in a direction reverse to the rotation direction of the photosensitive drum. With the rotation of the photosensitive drum and the developing roller, toner is supplied from the developing roller to the surface of the drum body, and an electrostatic latent image formed on the surface of the drum body is developed to a toner image. In addition, a supply roller is rotatably kept in the developing cartridge. With the rotation of the supply roller, the toner in the developing cartridge is supplied to the surface of the developing roller.

A coupling member and a gear array are arranged at one of the sides of the developing cartridge. Driving force from a motor provided in the apparatus body is input to the coupling member. Then, since the driving force is transferred from the coupling member to the developing roller and the supply roller via the gear array, the developing roller and the supply roller are driven and rotated (see, for example, No. 2001-249542).

The gear array includes a plurality of gears, that is, a developing roller gear and a supply roller gear which are directly connected to the rotation axes of the developing roller and the supply roller, respectively, multiple intermediate gears for transferring the driving force input to the coupling member to the developing roller gear and supply roller gear, and the like. Therefore, if these gears are not arranged in suitable positions, the area occupied by the gears of the developing cartridge when viewed from the shaft direction of the developing roller becomes larger, and thus the miniaturization of the developing cartridge is difficult.

SUMMARY

Accordingly, it is an aspect of the present invention to provide a developing cartridge which can reduce the area occupied by gears.

According to an illustrative embodiment of the present invention, there is provided a developing cartridge including:

a frame having a first side plate and a second side plate spaced opposite from the first side plate; a developer carrying member which is rotatably supported between the first side plate and the second side plate, and which is configured to carry developer; a developer supplying member which is rotatably supported between the first side plate and the second side plate, and which is configured to supply developer to the developer carrying member; a driving force input member which is rotatably supported by the first side plate, and to which driving force is input from outside; a primary developing gear which is provided at an end of the developer carrying member at the side of the first side plate, and to which the driving force from the driving force input member is transferred; a secondary developing gear which is provided at an end of the developer carrying member at the side of the second side plate; and a supply gear which is provided at an end of the developer supplying member at the side of the second side plate, and to which the driving force from the secondary developing gear is transferred, wherein the driving force input member and the supply gear are arranged such that at least parts of projections thereof in a direction of a rotation axis of the developer supplying member on a projection plane orthogonal to the rotation axis overlap.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Below, illustrative embodiments of the present invention will be described in detail with reference to the attached drawings.

1. Laser printer

Figure 1:
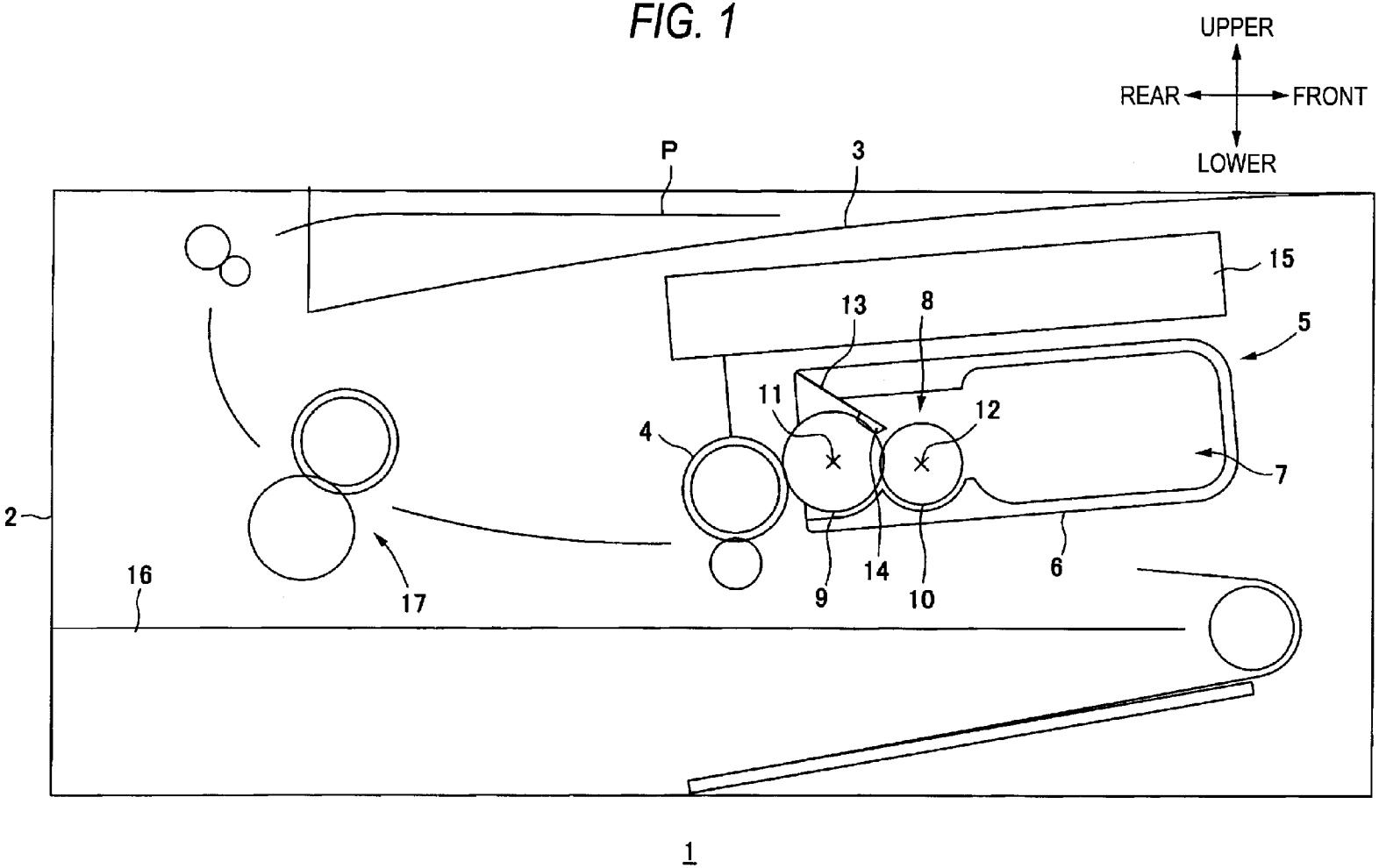
FIG. 1 is a section view of a laser printer including a developing cartridge according to one embodiment of the present invention.

As shown in FIG. 1, a laser printer 1 includes a body casing 2. The body casing 2 is roughly rectangular and has a size in the up-down direction that is smaller than that in the front-rear direction. A discharging tray 3 is formed at the top of the body casing 2. A sheet P on which an image is formed in the body casing 2 is discharged to the discharging tray 3.

In addition, in the description below, the downstream of the discharging direction of the sheet P to the discharging tray 3 is referred to as the front side of the laser printer 1. For the laser printer 1, the directional terminology, such as "upper", "lower", "left" and "right", is used when the laser printer 1 is viewed from the front side thereof. In addition, for the developing cartridge 5, which will be described below, the directional terminology, such as "front" and "rear" is used when it is mounted in the body casing 2, and the direction terminology, such as "upper", "lower", "left" and "right" is used when the developing cartridge 5 is viewed from the front thereof.

A photosensitive drum 4 is arranged roughly in the center of the body casing 2 in the front-rear direction. The photosensitive drum 4 is provided to be rotatable around the rotation axis extending in the left-right direction.

The developing cartridge 5 is mounted in the body casing 2 and in front of the photosensitive drum 4. The developing cartridge 5 can be removed from the body casing 2 when the front cover (not shown in the figure) provided at the front of the body casing 2 is open.

The developing cartridge 5 includes a frame 6. A toner storage chamber 7 and a developing chamber 8 are formed intercommunicatingly in the frame 6, and are adjacent to each other in the front-rear direction.

Toner is stored in the toner storage chamber 7.

In the developing chamber 8, a developing roller 9 (an example of a developer carrying member) and a supply roller 10 (an example of a developer supplying member) are provided to be rotatable respectively around a developing rotation axis 11 and a supply rotation axis 12.

The developing roller 9 is arranged so that a part of its surface is exposed at the rear end of the frame 6. The developing cartridge 5 is mounted in the body casing 2 so that the surface of the developing roller 9 contacts the surface of the photosensitive drum 4.

The supply roller 10 is arranged so that its surface contacts the surface of the developing roller 9 at the front of the developing roller 9.

In addition, a layer thickness regulating blade 13 (an example of a layer thickness regulating member) is provided in the developing chamber 8. The layer thickness regulating blade 13 is a thin plate extending in the left-right direction. Its upper end is supported by the upper rear end of the frame 6, and its lower end is a free end 14, and is pressed against the surface of the developing roller 9 from the upper front.

The toner in the toner storage chamber 7 is supplied to the developing chamber 8 with the rotation of an agitator (not shown in the figure) provided in the toner storage chamber 7. The toner in the developing chamber 8 is supplied to the surface of the developing roller 9 with the rotation of the supply roller 10. With the rotation of the developing roller 9, the toner supplied onto the developing roller 9 moves between the free end 14 of the layer thickness regulating blade 13 and the surface of the developing roller 9. At this moment, the thickness of the toner carried on the surface of the developing roller 9 is regulated to a constant thickness, and the toner carried on the surface of the developing roller 9 becomes a thin layer.

In addition, an exposing unit 15 including a laser or the like is provided in the body casing 2 and over the photosensitive drum 4 and the developing cartridge 5.

When an image is to be formed, the photosensitive drum 4 is rotated at a certain speed in a clockwise direction viewed from the left side. A charger (not shown) for charging the surface of the photosensitive drum 4 is provided around the surface of the photosensitive drum 4, for example. As the photosensitive drum 4 is rotated, the surface of the photosensitive drum 4 is uniformly charged. On the other hand, a laser beam from the exposing unit 15 is emitted, based on the image data received from a personal computer (not shown in the figure) connected to the printer 1. The laser beam is emitted to the surface of the photosensitive drum 4, which is uniformly charged positively, and the surface of the photosensitive drum 4 is selectively exposed. In this way, the charges are selectively removed from the exposed portion of the photosensitive drum 4, and an electrostatic latent image is formed on the surface of the photosensitive drum 4. As the photosensitive drum 4 is rotated, the toner from the developing roller 9 is supplied to the electrostatic latent image when the electrostatic latent image is opposite to the developing roller 9. In this way, a toner image is formed on the surface of the photosensitive drum 4.

A sheet cassette 16 for accommodating sheets P is arranged at the bottom of the body casing 2. When images are to be formed, sheets P from the sheet cassette 16 are sent out piece by piece. The sheet P sent out from the sheet cassette 16 is conveyed through the space between the photosensitive drum 4 and the transferring roller 11 to the discharging tray 3 formed at the top of the body casing 2.

With the rotation of the photosensitive drum 4, the toner image on the surface of the photosensitive drum 4 is transferred to the sheet P when it is opposed the sheet P that moves between the photosensitive drum 4 and the transferring roller 11 and electrically attracted by the transferring roller 11.

A fixing unit 17 is provided downstream from the transferring roller 11 in the conveying direction of the sheets P. The sheet P on which a toner image is transferred passes the fixing unit 17 after the paper moves between the photosensitive drum 1 and the transferring roller 11. In the fixing unit 17, the toner image is fixed to be an image on the sheet P by heat and pressure. After the toner image is fixed on the sheet P, the sheet P is discharged to the discharging tray 3.

2. Developing Cartridge (1) Frame

Figure 2:
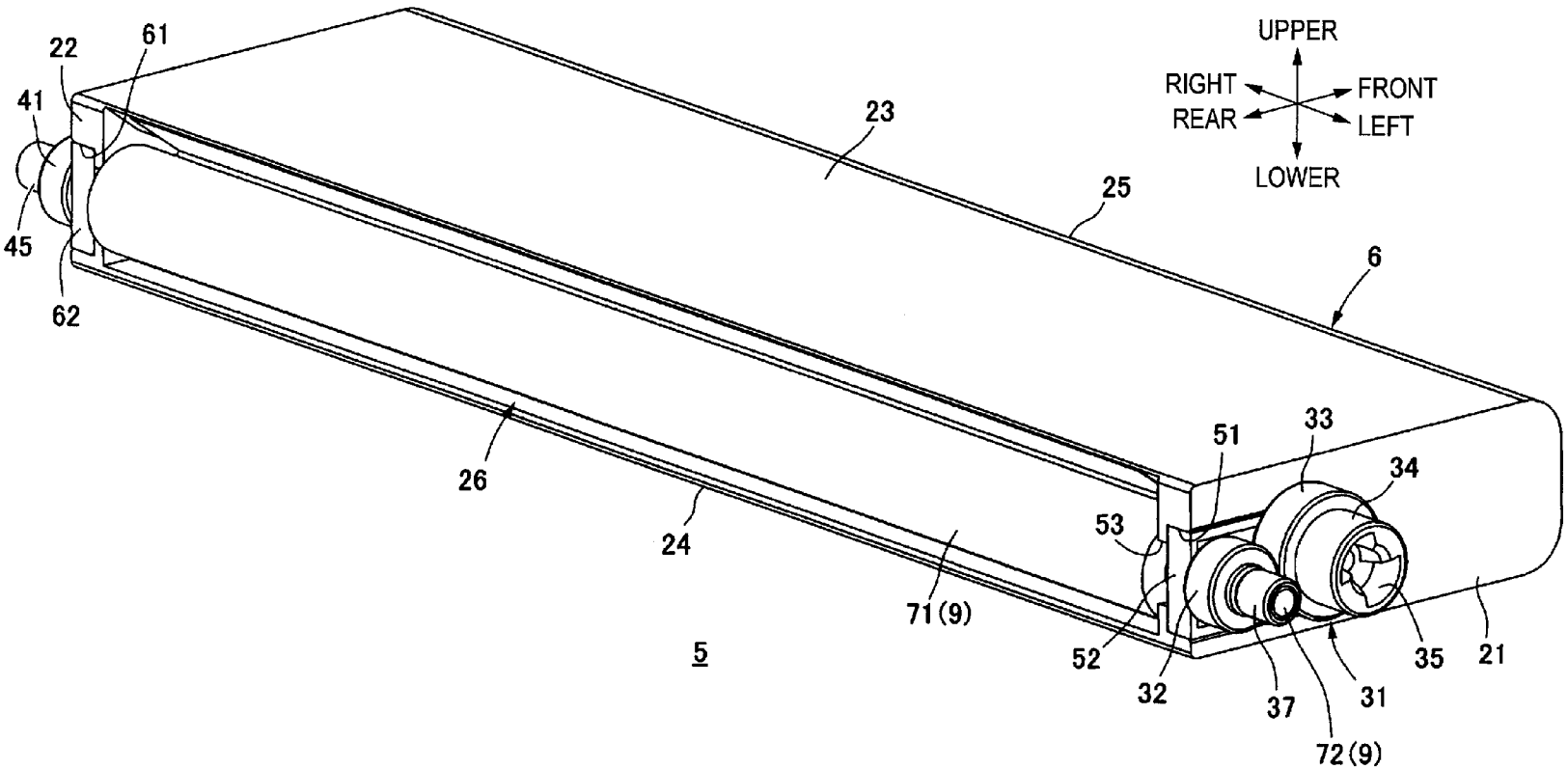
FIG. 2 is a perspective view of the developing cartridge shown in FIG. 1 viewed from the upper left rear.
Figure 3:
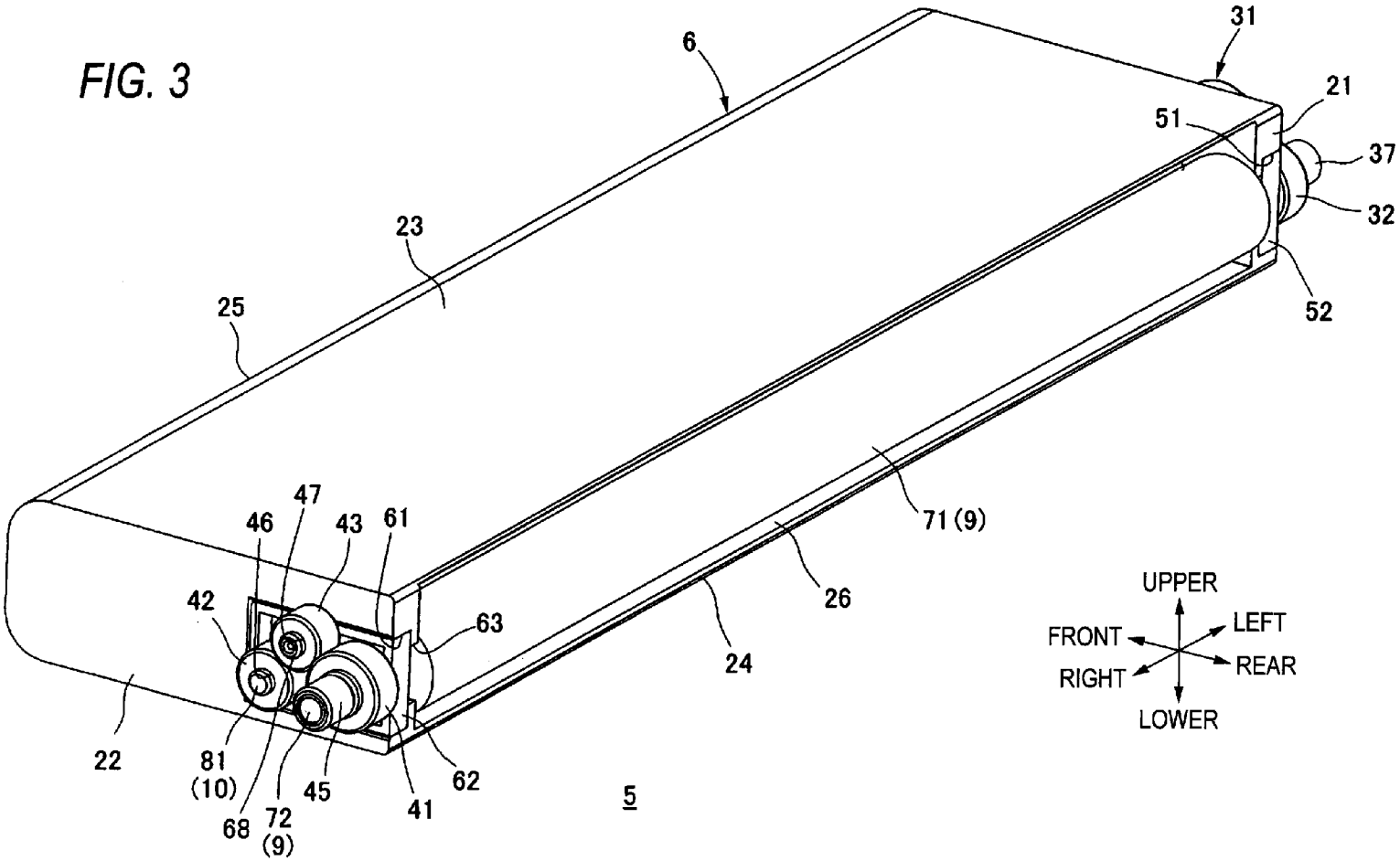
FIG. 3 is a perspective view of the developing cartridge shown in FIG. 1 viewed from the upper right rear.

As shown in FIG. 2 and FIG. 3, the frame 6 of the developing cartridge 5 is formed as a box in shape whose rear side is open. In particular, the frame 6 includes a first side plate 21 (see FIG. 2) and a second side plate 22 (see FIG. 3). The first side plate 21 and the second side plate 22 are opposite to each other in the left-right direction and are plates extending in the front-rear direction, respectively. In addition, the frame 6 includes a top plate 23 extending between the respective upper ends of the first side plate 21 and the second side plate 22, a bottom plate 24 extending between the respective lower ends of the first side plate 21 and the second side plate 22, and a front plate 25, which is provided to join the respective front edges of the first side plate 21, the second side plate 22, the top plate 23 and the bottom plate 24. The respective rear edges of the first side plate 21, the second side plate 22, the top plate 23 and the bottom plate 24 forms an opening 26, and the developing roller 9 is held at the rear end of the frame 6 and a part of the surface of the developing roller 9 exposes at the opening 26.

(2) Primary Driving Mechanism

As shown in FIG. 2, a coupling member 31 (an example of a driving force input member) and a primary developing gear 32 are rotatably provided outside the left first side plate 21 (at the left side), respectively.

The coupling member 31 integrally has a gear member 33 and a coupling member 34.

The gear member 33 has a round plate shape central axis extends in the left-right direction. Gear teeth are formed around the outer surface of the gear member 33. In addition, at the right end surface of the gear member 33, a round recess (not shown) is formed so that a coupling member shaft 58 (described later) can be inserted.

The coupling member 34 has a cylinder shape that has the same central axis as the gear member 33. The outer diameter of the coupling member 34 is smaller than that of the gear member 33, and the coupling member 34 protrudes to the left from the left end surface of the gear member 33. An engaging recess 35 is formed at the tip end surface of the coupling member 34. A drive outputting member (not shown), which is provided in the body casing 2, is relatively unrotatably engaged to the engaging recess 35 from a left side. The driving force from a motor is transferred to the drive outputting member. While the drive outputting member is engaged with the engaging recess 35, the driving force is transferred to the drive outputting member, and the coupling member 31 rotates together with the drive outputting member.

The primary developing gear 32 is provided so that it can be rotated around a rotation axis that is identical to the developing rotation axis 11 of the developing roller 9 (see FIG. 1), and is arranged at the rear of the coupling member 31.

The primary developing gear 32 has a round plate shape, and gear teeth are formed around its outer surface. The gear teeth of the primary developing gear 32 engage with the gear teeth of the gear member 33 of the coupling member 31. In addition, in the central part of the primary developing gear 32, a through hole (not shown) is formed through which a developing roller shaft 72 (described later) can be inserted.

A covering member 37 has a cylinder shape that has the same central axis as the primary developing gear 32, and relatively rotatably fitted with the developing roller shaft 72.

In this illustrative embodiment, with the engagement of the gear member 33 of the coupling member 31 and the primary developing gear 32, the driving force from the coupling member 31 is transferred to the developing roller 9. However, an idle gear may be provided between the coupling member 31 and the primary developing gear 32, and the driving force from the coupling member 31 may be indirectly transferred to the developing roller 9 via the idle gear.

(3) Secondary Driving Mechanism

On the other hand, as shown in FIG. 3, a secondary developing gear 41, a supply gear 42 and an idle gear 43 are rotatably provided outside the second side plate 22 (at the right side), respectively.

The secondary developing gear 41 is provided to be rotatable around a rotation axis which is identical to the developing rotation axis 11 of the developing roller 9 (see FIG. 1).

The secondary developing gear 41 has a round plate, and gear teeth are formed y around its outer surface. In addition, in the central part of the secondary developing gear 41, a through hole (not shown) is formed through which the developing roller shaft 72 (described later) can be inserted.

A covering member 45 has a cylinder shape which has the same central axis as the secondary developing gear 41, and is relatively rotatably engaged with the developing roller shaft 72.

The supply gear 42 is provided to be rotatable around a rotation axis which is identical to the supply rotation axis 12 of the supply roller 10 (see FIG. 1). The supply gear 42 has a round plate shape, and gear teeth are formed around its outer surface. In addition, in the central part of the supply gear 42, a round through hole 46 is formed through which a supply roller shaft 81 described later can be inserted.

An idle gear 43 is arranged at the upper front of the secondary developing gear 41 and at the upper rear of the supply gear 42, and is provided to be rotatable around a rotation axis extending in the left-right direction. The idle gear 43 has a round plate, and gear teeth are formed around its outer surface. The gear teeth of the idle gear 43 engage with the gear teeth of the secondary developing gear 41 and the gear teeth of the supply gear 42. In addition, in the central part of the idle gear 43, a round hole 47 is formed through which an idle gear shaft 68 described later can be inserted.

(4) Primary Supporting Member

Figure 4:
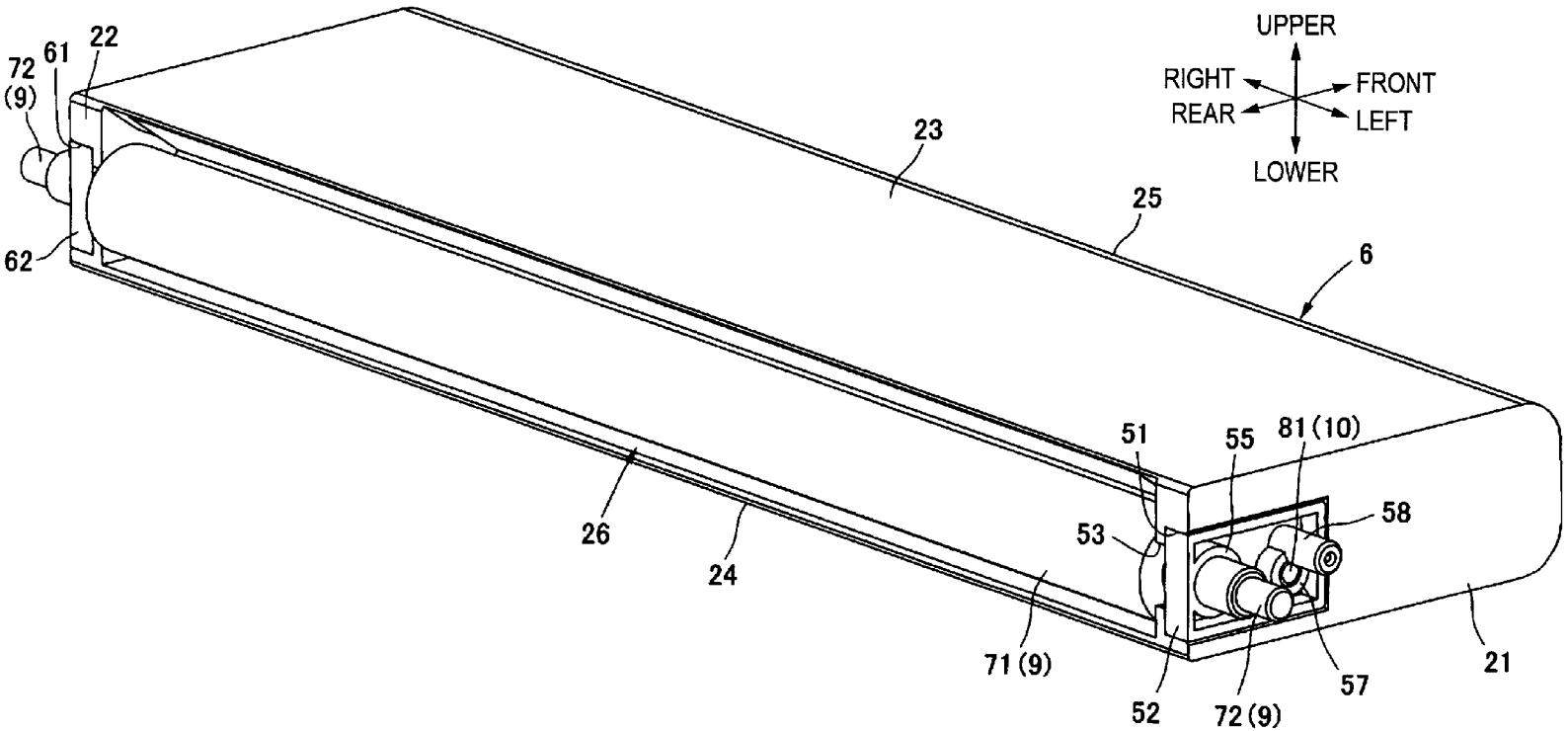
FIG. 4 is a perspective view of the developing cartridge shown in FIG. 1 viewed from the upper left rear when the coupling member and the primary developing gear are taken out.

As shown in FIG. 4, at the rear end of the first side plate 21, a rectangular first fitting part 51 (viewed from the side) is formed as a recess from the left side surface to the right side. Thus, a primary supporting member 52 is fitted with the first fitting part 51 from the left side. Furthermore, a rectangular opening 53, which extends partly in the front-rear direction opposite to the first fitting part 51, is formed in the first side plate 21. The primary supporting member 52 fitted with the first fitting part 51 exposes to the right side via the opening 53 except the parts at the upper end and the lower end.

Figure 5:
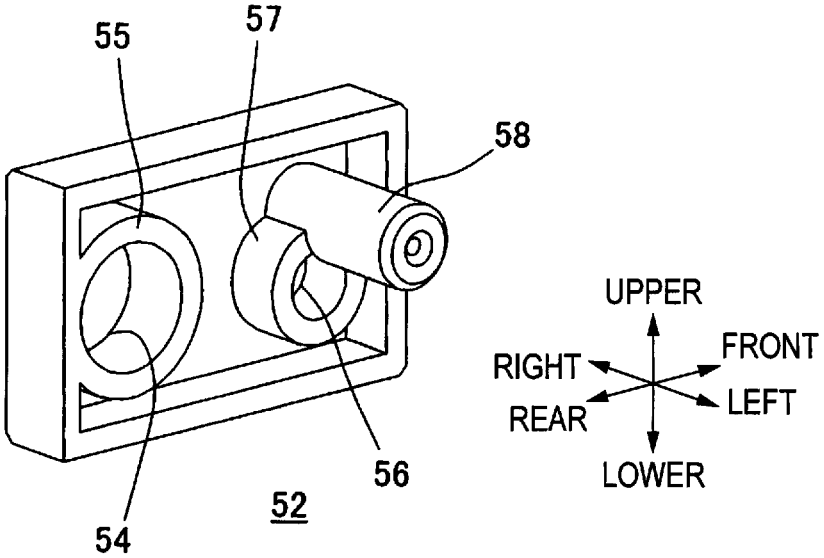
FIG. 5 is a perspective view of the primary supporting member shown in FIG. 2.

The primary supporting member 52 is a rectangular plate, as shown in FIG. 5. The primary supporting member 52 may be made of material having a higher rigidity than that of the first side plate 21.

At the rear end of the primary supporting member 52, a developing roller shaft insertion hole 54 is formed as a through hole. Around the developing roller shaft insertion hole 54, a cylindrical developing roller shaft insertion wall 55 is formed, which has a continuous inner surface and protrudes to the left side.

In the primary supporting member 52, a supply roller shaft insertion hole 56 is formed as a through hole, which is in front of the developing roller shaft insertion hole 54 and spaced apart from it. Around the supply roller shaft insertion hole 56, a cylindrical supply roller shaft insertion wall 57 is formed, which has a continuous inner surface and protrudes to the left side.

In addition, in the primary supporting member 52, a cylindrical coupling member shaft 58 (an example of a shaft) is formed as protruding to the left. The coupling member shaft 58 at the upper front of the supply roller shaft insertion hole 56, is arranged so that a part of the coupling member shaft 58 breaks into the supply roller shaft insertion wall 57, and protrudes further to the left than the supply roller shaft insertion wall 57. Since the coupling member shaft 58 is relatively rotatably inserted into the recess (not shown in the figure) formed in the coupling member 31, the coupling member 31 is rotatably supported by the coupling member shaft 58.

(5) Secondary Supporting Member

Figure 6:
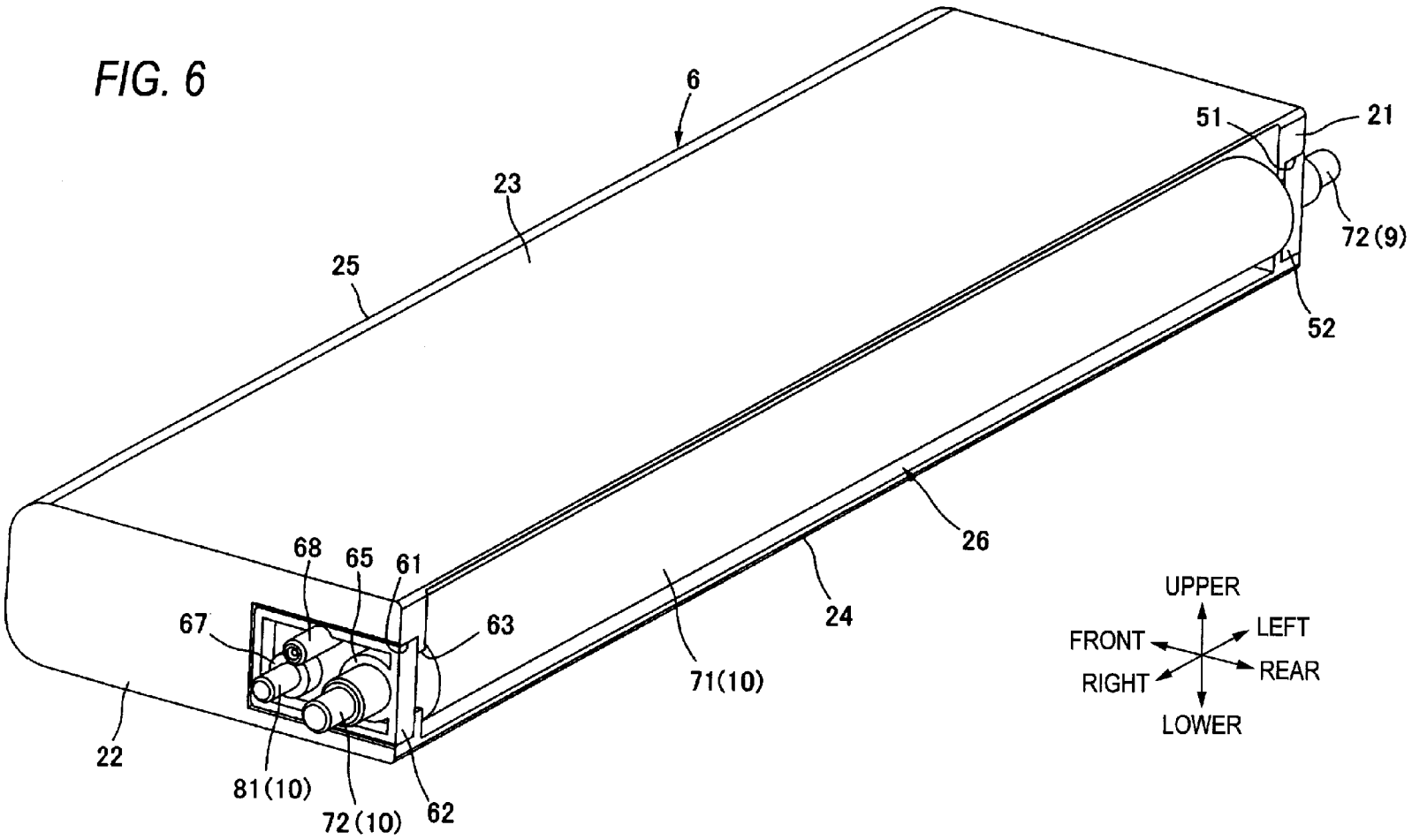
FIG. 6 is a perspective view of the developing cartridge shown in FIG. 1 viewed from upper right rear when the secondary developing gear, the supply gear and the idle gear are taken out.

As shown in FIG. 6, at the rear end of the second side plate 22, a rectangular second fitting part 61 (viewed from the side) is formed as a recess from the left side surface to the right side. Thus, a secondary supporting member 62 is fitted with the second fitting part 61 from the left side. Furthermore, a rectangular opening 63, which extends partly in the front-rear direction opposite to the second fitting part 61, is formed in the second side plate 22. The secondary supporting member 62 fitted with the second fitting part 61 is exposed to the right side via the opening 63, except the parts at the upper end and the lower end.

Figure 7:
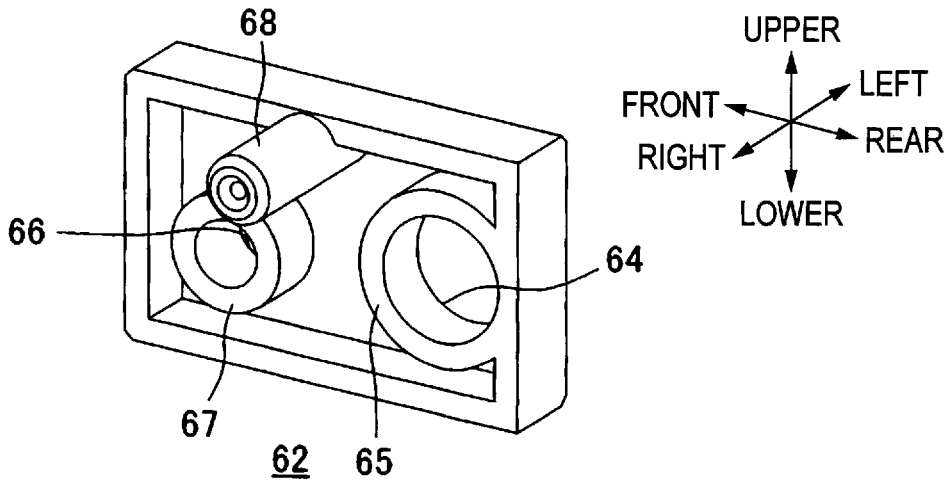
FIG. 7 is a perspective view of the secondary supporting member shown in FIG. 3.

The secondary supporting member 62 is a rectangular plate, as shown in FIG. 7. The secondary supporting member 62 may be made of material having a higher rigidity than that of the second side plate 22.

At the rear end of the secondary supporting member 62, a developing roller shaft insertion hole 64 is formed as a through hole. Around the developing roller shaft insertion hole 64, a cylindrical developing roller shaft insertion wall 65 is formed, which has a continuous inner surface and protrudes to the right side.

In the secondary supporting member 62, a supply roller shaft insertion hole 66 is formed as a through hole, which is in front of the developing roller shaft insertion hole 64 and spaced apart from it. Around the supply roller shaft insertion hole 66, a cylindrical supply roller shaft insertion wall 67 is formed, which has a continuous inner surface and protrudes to the left side.

In addition, in the secondary supporting member 62, a cylindrical idle gear shaft 68 is formed as protruding to the left. The idle gear shaft 68 is arranged at the upper rear of the supply roller shaft insertion hole 66, and protrudes to the right much more than the supply roller shaft insertion wall 67. Since the idle gear shaft 68 is relatively unrotatably inserted through the round hole 47 of the idle gear 43, the idle gear 43 is rotatably supported by the idle gear shaft 68.

(6) Developing Roller

As shown in FIGS. 4 and 6, the developing roller 9 has a cylindrical roller body 71 extending in the left-right direction, a developing roller shaft 72, which is inserted through the roller body 71 along its central axis. The left and right ends of the developing roller shaft 72 protrude from the left and right end surface of the roller body 71, respectively. Thus, as shown in FIG. 4, the left end of the developing roller shaft 72, which is the left end of the developing roller 9, is relatively rotatably inserted through the developing roller shaft insertion hole 54 of the primary supporting member 52 and the developing roller shaft insertion wall 55. On the other hand, as shown in FIG. 6, the right end of the developing roller shaft 72, which is the right end of the developing roller 9, is relatively rotatably inserted through the developing roller shaft insertion hole 64 of the secondary supporting member 62 and the developing roller shaft insertion wall 65. In this way, the developing roller shaft 72 is rotatably supported by the primary supporting member 52 and the secondary supporting member 62.

Thus, the part of the developing roller shaft 72 that protrudes to the left from the developing roller shaft insertion wall 55 is relatively rotatably inserted through (loosely fitted) to a hole (not shown in the figure) formed in the primary developing gear 32, and relatively unrotatably inserted through the covering member 37 of the primary developing gear 32. In this way, as shown in FIG. 2, the primary developing gear 32 is relatively unrotatably attached to the developing roller shaft 72.

In addition, the part of the developing roller shaft 72 that protrudes to the right from the developing roller shaft insertion wall 65 is relatively rotatably inserted through (loosely fitted) to a hole (not shown in the figure) formed in the secondary developing gear 41, and relatively unrotatably inserted through the covering member 45 of the secondary developing gear 42. In this way, as shown in FIG. 3, the secondary developing gear 41 is relatively unrotatably attached to the developing roller shaft 72.

(7) Supply Roller

As shown in FIGS. 4 and 6, the supply roller 10 has a supply roller shaft 81 extending in the left-right direction. The left end and the right end of the supply roller shaft 81 are the left end and the right end of the supply roller 10, respectively. Thus, as shown in FIG. 4, the left end of the supply roller shaft 81 is relatively rotatably inserted through the supply roller shaft insertion hole 56 of the primary supporting member 52. On the other hand, the right end of the supply roller shaft 81 is relatively rotatably inserted through the supply roller shaft insertion hole 66 of the secondary supporting member 62. In this way, the supply roller shaft 81 is rotatably supported by the primary supporting member 52 and the secondary supporting member 62.

Thus, the right end of the supply roller shaft 81 protrudes to the right from the supply roller shaft insertion hole 66 of the secondary supporting member 62, and as the protruded part thereof is relatively unrotatably inserted through the hole 46 of the supply gear 42, as shown in FIG. 3, the supply gear 42 is relatively unrotatably attached to the supply roller shaft 81.

(8) Driving Transferring Path

When driving force is input from the drive outputting member (not shown) to the coupling member 31, the coupling member 31 is rotated in a clockwise direction viewed from the left side. Because of the engagement of the gear teeth of the gear member 33 of the coupling member 31 and the gear teeth of the primary developing gear 32, when the coupling member 31 rotates, the primary developing gear 32 rotates in a counterclockwise direction viewed from the left side. With the rotation of the primary developing gear 32, the developing roller 9 and the secondary developing gear 41 rotate in a clockwise direction viewed from the right side.

Because of the engagement of the gear teeth of the secondary developing gear 41 and the gear teeth of the idle gear 43, when the secondary developing gear 41 rotates, the idle gear 43 rotates in a counterclockwise direction viewed from the right side. Because of the engagement of the gear teeth of the idle gear 43 and the gear teeth of the supply gear 42, when the idle gear 43 rotates, the supply gear 42 rotates in a clockwise direction viewed from the right side. With the rotation of the supply gear 42, the supply roller 10 rotates in a clockwise direction viewed from the right side.

(9) Projection

Figure 8:
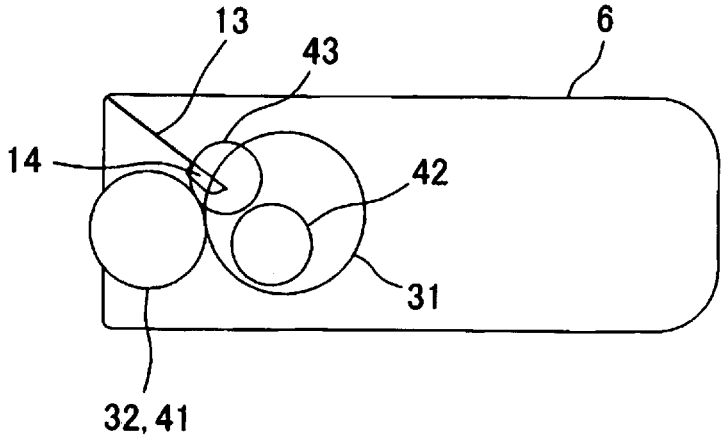
FIG. 8 is a projection view of the coupling member, the primary developing gear, the secondary developing gear, the supply gear, the idle gear and the layer thickness regulating blade on a vertical plane.

As shown in FIG. 8, the coupling member 31 and the supply gear 42 are arranged so that when they are projected on a vertical plane from the left side, parts of their projections overlap.

In addition, the supply roller 10 is arranged in such a position that the supply rotation axis 12 or a straight line extending along the supply rotation axis 12 falls within the projection of the coupling member 31 on a vertical plane from the left side.

Furthermore, the layer thickness regulating blade 13 is arranged so that the projection of the free end 14 on a vertical plane from the left side falls within the projection of the idle gear 43 on the vertical plane from the left side.

3. Function and Advantage (1) Function and Advantage 1

As described above, the frame 6 includes the first side plate 21 and the second side plate 22. The first side plate 21 and the second side plate 22 are spaced opposite from each other. The coupling member 31 to which driving force is input from outside is rotatably supported by the first side plate 21. The developing roller 9 and the supply roller 10 are rotatably supported between the first side plate 21 and the second side plate 22. The primary developing gear 32 and the secondary developing gear 41 are respectively provided at the left end (the end at the side of the first side plate 21) and the right end (the end at the side of the second side plate 22) of the developing roller 9. The driving force from the coupling member 31 is transferred to the primary developing gear 32. With the transferring of the driving force, the primary developing gear 32 rotates, and with the rotation of the primary developing gear 32, the developing roller 9 and the secondary developing gear 41 rotate. The supply gear 42 is provided at the right end of the supply roller 10. The driving force from the idle gear 43, which is engaged with the secondary developing gear 41, is transferred to the supply gear 42. In this way, when the secondary developing gear 41 rotates, the rotation of the secondary developing gear 41 is transferred to the supply gear 42 via the idle gear 43 by the driving force, and the supply gear 42 and the supply roller 10 rotate together.

Further, the coupling member 31 and the supply gear 42 are arranged such that when they are projected in the left-right direction on a vertical plane, at least parts of their projections overlap. That is, the coupling member 31 and the supply gear 42 are arranged such that they are located at the side of the first side plate 21 and at the side of the second side plate 22 respectively, and when viewed from the left-right direction, at least parts of them overlap. In this way, the area occupied by the primary developing gear 32, the secondary developing gear 41, the idle gear 43 and the supply gear 42, when viewed from the left-right direction, can be reduced. Thus, the size of the frame 6, when viewed from the axis direction, can be reduced, and the miniaturization or thinning of the developing cartridge 5 can be achieved.

Furthermore, as the supply gear 42 is arranged at the side opposite to the coupling member 31 for transferring the driving force, the diameter of the developing gear 36 can be increased. With the increase of the diameter of the developing gear 36, because the change of angular speed of the developing gear 36 can be controlled, the rotation variation of the developing roller 9 is suppressed. Therefore, the low quality images due to the rotation variation of the developing roller 9 can be suppressed.

(2) Function and Advantage 2

The rotation axis 12 of the supply roller 10 falls within the projection of the coupling member 31 on a vertical plane from the left side. In other words, the supply roller 10 is arranged such that when viewed from the left-right direction, its rotation axis 12 overlaps with the coupling member 31. In this way, the area occupied by the supply roller 10 and the coupling member 31, when viewed from the left-right direction, can be reduced, and the further reduction of the size of the frame 6 (the developing cartridge 5), when viewed from the left-right direction, can be achieved.

(3) Function and Advantage 3

The second side plate 22 is provided with the secondary supporting member 62. The ends of the developing roller 9 and the supply roller 10 at the side of the second side plate 22 (their right ends) and the idle gear 43 are rotatably supported by the secondary supporting member 62, respectively and collectively. Thus, the distances among the respective rotation axes of the developing roller 9, the supply roller 10 and the idle gear 43 can be kept constant. Therefore, the secondary developing gear 41, the supply gear 42 and the idle gear 43 can be ensured to be engaged. Further, since the second side plate 22 and the secondary supporting member 62 are provided as separate members, the secondary supporting member 62 may be made of different material from that of the second side plate 22. That is, the secondary supporting member 62 which requires higher precision can be made of material having higher rigidity than that of the second side plate 22.

(4) Function and Advantage 4

On the other hand, the primary supporting member 52 is provided in the first side plate 21. The left end (the end at the side of the first side plate 21) of the supply roller 10 is rotatably supported by the primary supporting member 52. In addition, the coupling member shaft 58 is formed in the primary supporting member 52 as protruding to the outside (the left side) in the left-right direction. Thus, the coupling member 31 is rotatably supported by the coupling member shaft 58. As a result, the end of the supply roller 10 at the side of the first side plate 21 and the coupling member 31 can be rotatably supported only by the primary supporting member 52, respectively.

(5) Function and Advantage 5

Furthermore, the left end of the developing roller 9 is supported by the primary supporting member 52. In this way, the distance between the rotation axes of the primary developing gear 32 and the coupling member 31 can be kept constant, and the reliable engagement of the primary developing gear 32 and the gear member 33 of the coupling member 31 can be ensured. Further, since the first side plate 21 and the primary supporting member 52 are provided as separate members, the primary supporting member 52 may be made of different material from that of the first side plate 21. That is, the primary supporting member 52 which requires higher precision can be made of material having higher rigidity than that of the first side plate 21.

(6) Function and Advantage 6

The layer thickness regulating blade 13 is supported by the frame 6. The free end 14 of the layer thickness regulating blade 13 contacts with the developing roller 9. The layer thickness of the toner carried on the developing roller 9 can be regulated by the free end 14 of the layer thickness regulating blade 13. The layer thickness regulating blade 13 is arranged such that the projection of the free end 14 on a vertical plane in the left-right direction falls into the projection of the idle gear 43 on the vertical plane in the left-right direction. In other words, the layer thickness regulating blade 13 is arranged such that when viewed from the left-right direction, its free end 14 overlaps with the idle gear 43. The further reduction of the size of the frame 6 (the developing cartridge 5), when viewed from the left-right direction, can be achieved by the above configuration.

4. MODIFIED EXAMPLES

(1) Modified Example 1

Figure 9:
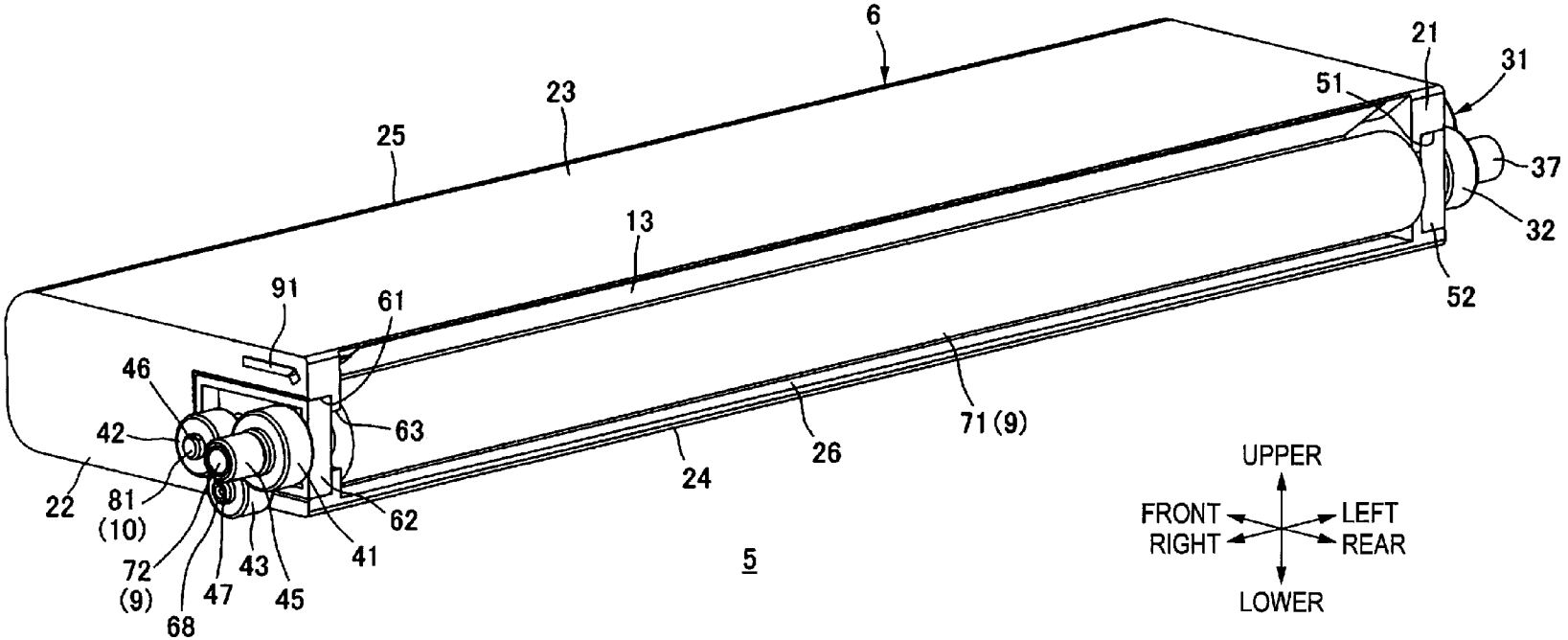
FIG. 9 is a perspective view of the developing cartridge according to a modified example viewed from upper right rear.
Figure 10:
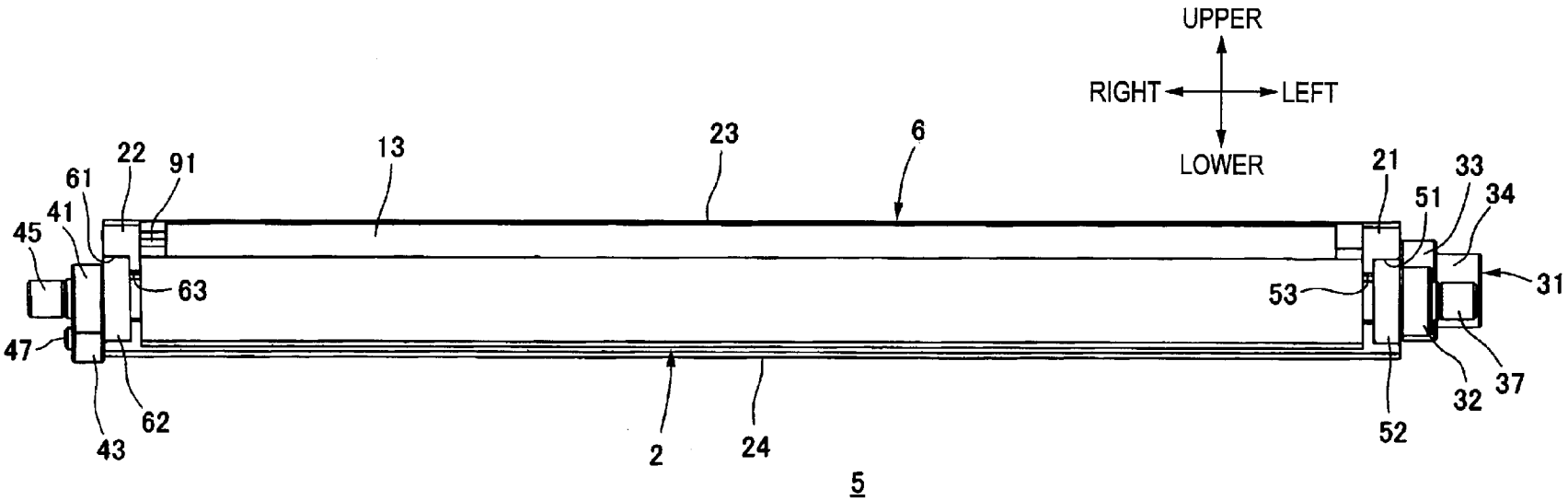
FIG. 10 is a front view of the developing cartridge shown in FIG. 9.

As shown in FIGS. 9 and 10, in the second side plate 22, a blade electrode 91 (an example of an electrode) that is electrically connected with the layer thickness regulating blade 13, can be provided in a position opposing the layer thickness regulating blade 13.

The blade electrode 91 is made of a thin metal plate, and extends in the front-rear direction and in the left-right direction by being inserted through the second side plate 22. In the frame 6, the left end of the blade electrode 91 connects to the right end of the edge of the layer thickness regulating blade 13.

In this case, it may advantageous that, in the secondary supporting member 62, the idle gear shaft 68 is arranged at the lower rear of the supply roller shaft insertion hole 66 (see FIG. 7) so that the secondary developing gear 41 and the supply gear 42 is sandwiched between the idle gear 43 and the blade electrode 91, that is, the idle gear 43 is opposite to the blade electrode 91 and arranged below the secondary developing gear 41 and the supply gear 42. In this way, the idle gear 43 would not become obstructive for the arrangement of the blade electrode 91. Therefore, the optimum arrangement of the secondary developing gear 41, the supply gear 42, the idle gear 43, the blade electrode 91 and the layer thickness regulating blade 13 can be achieved.

(2) Modified Example 2

The inventive concept of the present invention is also applied to color printers.

In addition, the idle gear 43 can be modified without departing from the spirit of the present invention. In other words, for example, three idle gears can be used between the secondary developing gear 41 and the supply gear 42.

In addition, it is also possible that the secondary developing gear 41 is directly, without an idle gear, engaged with the supply gear 42 to transfer the driving force.

What is claimed is:

1. A developing cartridge comprising:

a frame having a first side plate and a second side plate spaced opposite from the first side plate;

a developer carrying member which is rotatably supported between the first side plate and the second side plate, and which is configured to carry developer;

a developer supplying member which is rotatably supported between the first side plate and the second side plate, and which is configured to supply developer to the developer carrying member;

a driving force input member which is rotatably supported by the first side plate, and to which driving force is input from outside;

a primary developing gear which is provided at an end of the developer carrying member at the side of the first side plate, and to which the driving force from the driving force input member is transferred; and a supply gear which is provided at an end of the developer supplying member, and to which the driving force from the driving force input member is transferred, wherein the driving force input member and the supply gear are arranged such that at least parts of projections thereof in a direction of a rotation axis of the developer supplying member on a projection plane orthogonal to the rotation axis overlap, wherein the driving force input member and the supply gear are configured such that the supply gear rotates in a first rotation direction as the driving force input member rotates in a second rotation direction opposite to the first rotation direction, and wherein the developer supplying member is arranged such that the rotation axis of the developer supplying member falls within the projection of the driving force input member on the projection plane in the direction of the rotation axis.

2. The developing cartridge according to claim 1, further comprising:

a secondary developing gear which is provided at an end of the developer carrying member at the side of the second side plate, and wherein the supply gear is configured such that driving force from the secondary developing gear is transferred to the supply gear.

3. The developing cartridge according to claim 2, further comprising:

an idle gear which is provided at the side of the second side plate, and which is configured to transfer the driving force from the secondary developing gear toward the supply gear;

a secondary supporting member provided in the second side plate, which rotatably supports the idle gear and the ends of the developer carrying member and the developer supplying member, respectively, at the side of the second side plate, collectively.

4. The developing cartridge according to claim 3, wherein the secondary supporting member is provided as a separate member from the second side plate.

5. The developing cartridge according to claim 4, wherein the secondary supporting member is made of material having a higher rigidity than that of the second side plate.

6. The developing cartridge according to claim 2, further comprising:

a primary supporting member provided in the first side plate, which rotatably supports the end of the developer supplying member at the side of the first side plate, wherein the driving force input member is rotatably supported by a shaft which protrudes from the primary supporting member to the outside in the direction of the rotation axis.

7. The developing cartridge according to claim 6, wherein the end of the developer carrying member at the side of the first side plate is rotatably supported by the primary supporting member.

8. The developing cartridge according to claim 7, wherein the primary supporting member is provided as a separate member from the first side plate.

9. The developing cartridge according to claim 8, wherein the primary supporting member is made of material having a higher rigidity than that of the first side plate.

10. The developing cartridge according to claim 2, further comprising:

an idle gear which is provided at the side of the second side plate, and which is configured to transfer the driving force from the secondary developing gear toward the supply gear; and a layer thickness regulating member supported to the frame, which has a free end configured to contact the developer carrying member to regulate a layer thickness of the developer carried on the developer carrying member, wherein the layer thickness regulating member is arranged such that a projection of the free end on the projection plane in the direction of the rotation axis falls within a projection of the idle gear on the projection plane in the direction of the rotation axis.

11. The developing cartridge according to claim 2, further comprising:

an idle gear which is provided at the side of the second side plate, and which is configured to transfer the driving force from the secondary developing gear toward the supply gear;

a layer thickness regulating member provided in the frame, which has a free end configured to contact the developer carrying member to regulate the layer thickness of the developer carried on the developer carrying member; and an electrode arranged in the second side plate and electrically connected with the layer thickness regulating member, wherein the idle gear is arranged opposite to the electrode while sandwiching the secondary developing gear and the supply gear therebetween.

* * * * *